US007217085B2

(12) United States Patent
Inuzuka

(10) Patent No.: US 7,217,085 B2
(45) Date of Patent: May 15, 2007

(54) FUEL PUMP OF LOW FUEL INTAKE RESISTANCE

(75) Inventor: Yukio Inuzuka, Okazaki (JP)

(73) Assignee: Denso Corporation (JP)

( * ) Notice: Subject to any disclaimer, the term of this patent is extended or adjusted under 35 U.S.C. 154(b) by 0 days.

(21) Appl. No.: 11/314,235

(22) Filed: Dec. 22, 2005

(65) Prior Publication Data

US 2006/0140749 A1 Jun. 29, 2006

(30) Foreign Application Priority Data

Dec. 24, 2004 (JP) ..... 2004-374068

(51) Int. Cl.
*F04D 29/42* (2006.01)
*F04D 5/00* (2006.01)

(52) U.S. Cl. ..... 415/55.1; 415/55.2

(58) Field of Classification Search ..... 415/55.1, 415/55.2, 55.6, 98

See application file for complete search history.

(56) References Cited

U.S. PATENT DOCUMENTS 4,306,833 A * 12/1981 Sixsmith et al. ..... 415/55.4
5,129,796 A * 7/1992 Emmert et al. ..... 417/435
6,942,447 B2 9/2005 Ikeya

* cited by examiner

*Primary Examiner*—Edward K. Look
*Assistant Examiner*—Dwayne J White
(74) *Attorney, Agent, or Firm*—Nixon & Vanderhye PC

(57) ABSTRACT

A fuel pump to be disposed in a fuel tank to supply pressurized fuel to an internal combustion engine includes a motor section, a pump section including an impeller driven by the motor section and a cylindrical pump housing having a pump passage extending along the outer periphery of the impeller so as to pressurize fuel, a suction filter and a feed passage member disposed around the inlet port of the pump passage. The feed passage member has a smooth feed passage connecting the pump passage and the suction filter. The feed passage tapers off toward an inlet port of the pump passage that opens at a peripheral portion of the pump housing.

8 Claims, 3 Drawing Sheets

FUEL PUMP OF LOW FUEL INTAKE RESISTANCE

CROSS REFERENCE TO RELATED APPLICATION

The present application is based on and claims priority from Japanese Patent Application 2004-374068, filed Dec. 24, 2004, the contents of which are incorporated herein by reference.

BACKGROUND OF THE INVENTION

1. Field of the Invention

The present invention relates to a fuel pump that has a pump housing and an inlet port at a side of the pump housing.

2. Description of the Related Art

A fuel pump that has a pump housing, a pump passage having an inlet port, a motor and an impeller housed in the pump housing is well-known for pressurizing fuel in the pump passage, as disclosed in U.S. Pat. No. 6,942,447 B2 or JP-A-2004-100675 that is a counter part of the U.S. patent.

In the above fuel pump, the inlet port is opened at a circumferential side of the pump housing or the impeller to take fuel into the pump passage formed along the periphery of the impeller. Therefore, the fuel intake resistance of this type is smaller than another type of fuel pump that has an inlet port opened in the direction perpendicular to the rotation direction of the impeller. That is, the pump efficiency of the former fuel pump is higher than the latter fuel pump.

Incidentally, the pump efficiency $P_{eff}$ is expressed as follows:

$P_{eff}=(P\times Q)/(T\times N)$, wherein: T is a torque of the motor; N is a rotation speed of the motor; P is a pressure of fuel; and Q is a quantity of fuel discharged from the pump.

If the fuel intake resistance is reduced, the quantity of fuel to be discharged by the pump increases, and the pump efficiency increases.

FIG. 5 shows a fuel pump in which an inlet port 212 of a pump passage 210 is formed on a side of a pump housing 200. In the fuel pump, an intake resistance is generated when fuel is taken from portions around the inlet port 212 into the pump passage 210. In particular, the streamlines of the fuel flow peel off when the direction of the fuel flow sharply changes at an edge 214 of the inlet port 212. Accordingly, the effective sectional area of the fuel passage for taking fuel into the pump passage 210 reduces, resulting in that the fuel intake resistance increases to thereby reduce the pump efficiency.

SUMMARY OF THE INVENTION

Therefore, an object of the invention is to provide an improved fuel pump that has a high pump efficiency.

According to a feature of the invention, a fuel pump includes a motor section, a pump section, a feed passage member having a feed passage and a suction filter. The pump section includes an impeller and a pump housing having a pump passage extending along the outer periphery of the impeller so that the impeller can pressurize fuel that is fed from the suction filter through the feed passage. In the pump section, the pump passage has an inlet port opening at a side of the pump housing, and the feed passage smoothly extends toward the inlet port to be connected thereto at one end thereof.

With the above construction, fuel flows from the suction filter to the pump passage without peeling off. Therefore, the intake resistance of the fuel becomes lower. As a result, the pump efficiency is improved.

Preferably, the feed passage extends in line with the upstream portion of the pump passage. Further, one end of the feed passage connected to the pump passage has approximately the same cross-sectional area as the inlet port of the pump passage. Furthermore, the feed passage may have a shape tapering off toward the inlet port.

BRIEF DESCRIPTION OF THE DRAWINGS

Other objects, features and characteristics of the present invention as well as the functions of related parts of the present invention will become clear from a study of the following detailed description, the appended claims and the drawings. In the drawings:

DETAILED DESCRIPTION OF THE PREFERRED EMBODIMENTS

First Embodiment

Figure 1:
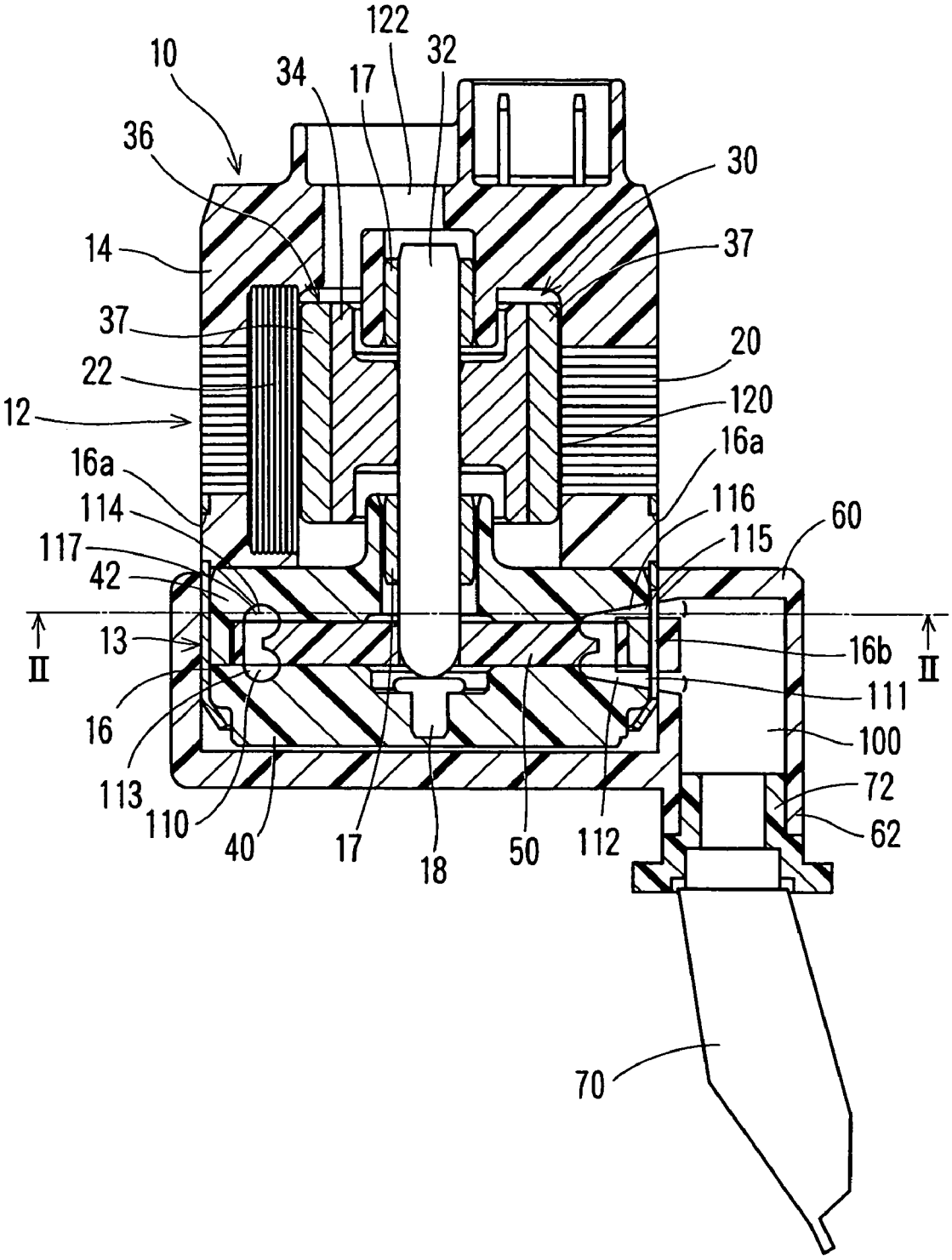
FIG. 1 illustrates a longitudinal cross-section of a fuel pump according to the first embodiment of the invention.
Figure 2:
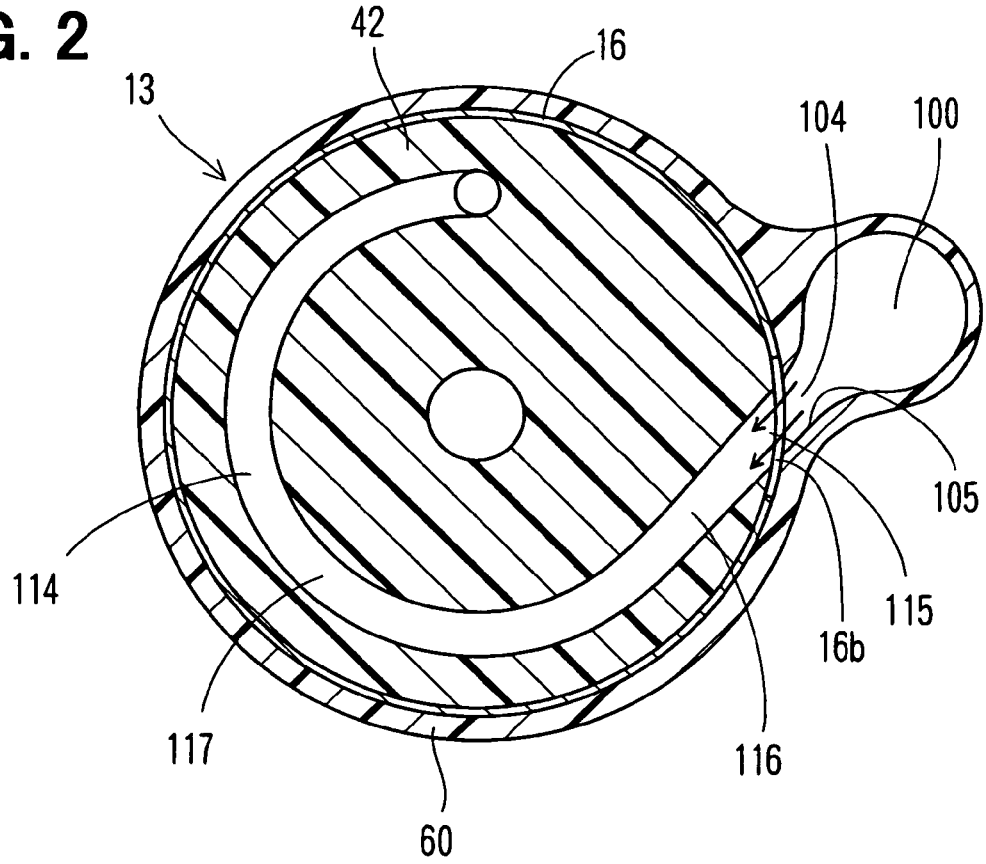
FIG. 2 is a cross-sectional plan view of the fuel pump shown in FIG. 1 cut along line II-II.

A fuel pump 10 according to the first embodiment will be described with reference to FIGS. 1–3.

The fuel pump 10 is an in-tank type fuel pump that is to be disposed in a fuel tank to pressurize fuel taken therein from the fuel tank via a suction filter 70. The fuel discharged from the fuel pump 10 is supplied to an internal combustion engine. The fuel pump 10 includes a motor section 12, a pump section 13 that is driven by the motor section 12, an end support cover 14, metal housing 16, a filter cover 60, etc.

The motor section 12 is a brushless motor that is constituted of a stator core 20, coils 22 and a rotor 30. The stator core 20 is constituted of axially laminated thin magnetic steel plates. The stator core 20 has six teeth that are disposed at equal intervals in the circumferential direction thereof to project toward the center of the motor section 12. Each coil 22 is wound around one of the teeth. The stator 20 and the coils 22 are molded in the end support cover 14. The metal housing 16 is also insert-molded in the end support cover 14 to support a pump cover 40. The metal housing 16 has a plurality of through holes 16*a* in which a portion of resinous material of the end support cover 14 is filled.

The rotor 30, which includes a shaft 32, a rotary core 34 and a cylindrical permanent magnet 36, is disposed inside the stator core 20. The permanent magnet 36 is disposed to surround the rotary core 34. The permanent magnet 36 has eight magnetic poles 37 formed in the rotating direction. The eight magnetic poles 37 are alternately polarized into N or S on the outer periphery thereof opposite the stator core 20.

The pump section 13 includes the pump cover 40, a pump casing 42, an impeller 50, etc. The pump cover 40 and the pump casing 42 form a cylindrical pump housing that supports and houses the impeller 50 so as to freely rotate therein. The pump casing 42 is sandwiched between the end support cover 14 and the pump cover 40 by means of the metal housing 16. The pump cover 40 and the pump casing 42, as a pump housing, provide two pump passages 110, 114 extending in a C-shape along the outer periphery of the impeller 50 on the opposite sides thereof.

The pump passage 110 has an inlet port 111 on the side of the pump cover 40, an intake passage 112 at the upstream portion thereof adjacent to the inlet port 11 and a main passage 113 at the middle thereof. The pump passage 114 has an inlet port 115 at the upstream end thereof on the side of the pump casing 42, an intake passage 116 at the upstream portion thereof adjacent to the inlet port 115 and a main passage 117 at the middle thereof. The fuel taken into the respective main passages 113, 117 is pressurized and discharged from respective discharge ports (not shown) of the pump casing 42 into fuel passage 120 between the stator core 20 and the rotor 30 and discharged from discharge port 122 of the fuel pump 10.

The filter cover 60 is a resinous member force-fitted to the outer periphery of the pump section 13. The filter cover 60 has a fuel inlet 62 at a side thereof and a fuel passage 100. The suction filter 70 is force-fitted to the filter cover 60 to remove foreign particles contained in fuel. As shown in FIG. 3, the fuel from which foreign particles are removed by the suction filter 70 is taken into the fuel passage 100 of the filter cover 60 and divided into two feed passages 102, 104, whose downstream ends are, respectively, smoothly connected to the intake passage 112, 116 of the pump passages 110, 114 at the inlet ports 111, 115. The metal housing 16 has apertures **16*b* that respectively connect the feed passages 102, 104 and the inlet ports 111, 115. Each of the feed passages 102, 104 is surrounded by a tapering wall that gradually narrows toward the inlet port 111 or 115. Accordingly, no edge is formed at the inlet ports 111, 115, so that the intake resistance of the feed passages 102, 104** can be kept to be low.

Figure 3:
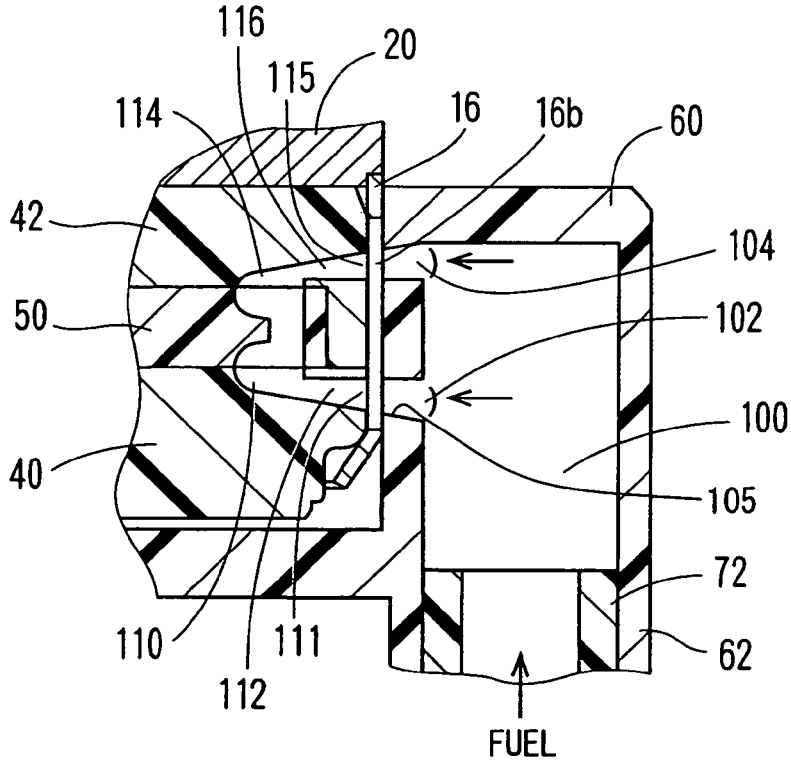
FIG. 3 is an enlarged view of a portion around an inlet port of a pump passage of the fuel pump according to the first embodiment.

As shown in FIG. 3, the feed passages 102, 104 extend toward the inlet ports 111, 115 on the same plane as the pump passages 110, 114, so that the direction in which the feed passages 102, 104 extend toward the inlet ports 111, 115 is almost the same as the direction in which intake passages 112, 116 extending between the inlet ports 111, 115 and the main passages 113, 117. The feed passages 102, 104 are respectively connected to the inlet ports 111, 115 in the same shape and cross section thereof without a step or the like. Therefore, the fuel that is filtered by the suction filter 70 flows straight from the feed passages 102, 104 through the inlet ports 111, 115 into the pump passages 110, 114. Therefore, the streamlines of the fuel flow are prevented from peeling off, so that the increase in the intake resistance can be prevented.

Second Embodiment

Figure 4:
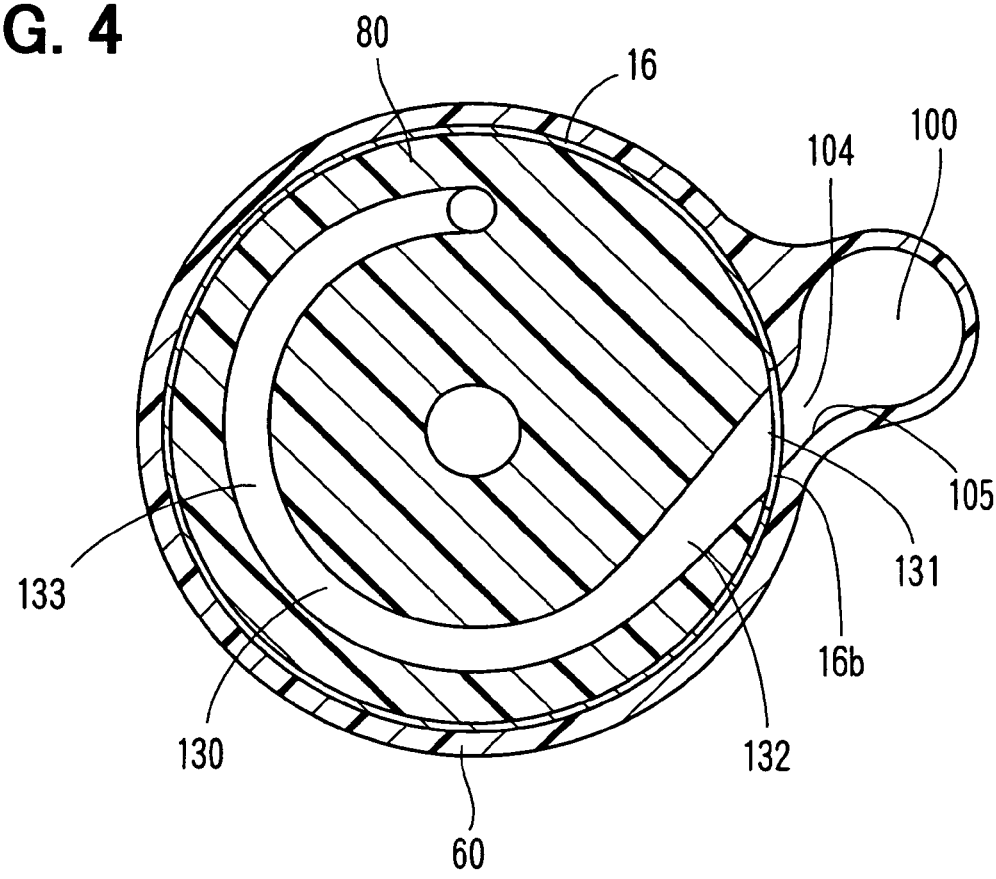
FIG. 4 is a cross-sectional plan view of the fuel pump according to the second embodiment of the invention.

A fuel pump according to the second embodiment of the invention will be described with reference to FIG. 4. The same reference numeral hereafter indicates the same or substantially the same part, portion or component as the first embodiment.

Figure 5:
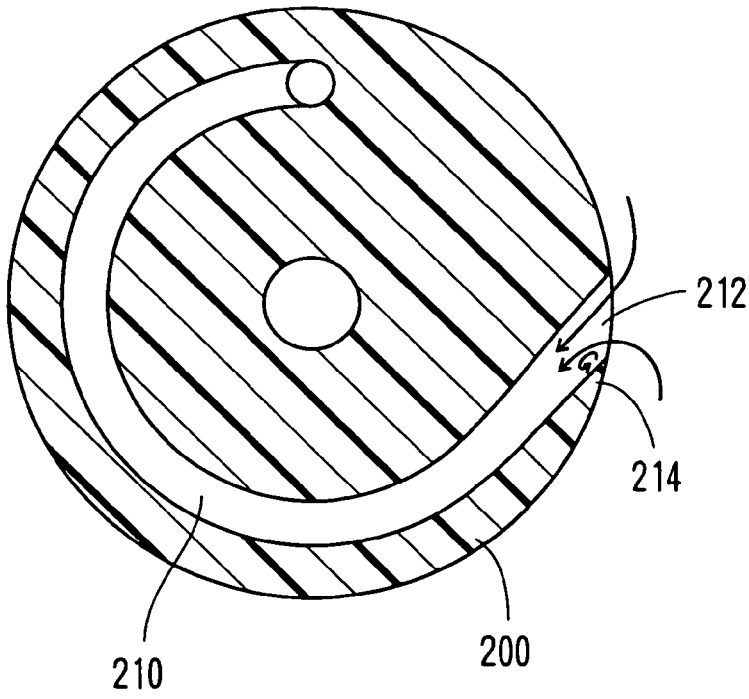
FIG. 5 PRIOR ART
FIG. 5 is a cross-sectional plan view of a prior art fuel pump.

A pump passage 130 formed in a pump casing 80 of the fuel pump according to the second embodiment has a fuel inlet port 131 whose cross-sectional area is formed to be larger than the cross-sectional area of the end of the feed passage 104 connected to the inlet port 131. The feed passage 104 extends toward the inlet port 131 on the same plane as the pump passage 130. The feed passages 104 is surrounded by the tapering wall 105 that gradually narrows toward the inlet port 115 in the same manner as the first embodiment. Although there is a small step between the feed passage 104 and the inlet port 131, peeling-off of the stream lines is not so significant as that of the prior art discussed with reference to FIG. 5.

Variations

The tapering wall 105 may be replaced by a straight wall as far as the cross-sectional area of the end of the feed passage 104 connected to the inlet port 131 is approximately the same as the cross-sectional area of the inlet port 131.

The motor section may be replaced by a permanent magnet type motor or other common DC motor.

In the foregoing description of the present invention, the invention has been disclosed with reference to specific embodiments thereof. It will, however, be evident that various modifications and changes may be made to the specific embodiments of the present invention without departing from the scope of the invention as set forth in the appended claims. Accordingly, the description of the present invention is to be regarded in an illustrative, rather than a restrictive, sense.

What is claimed is:

1. A fuel pump including a motor section, a pump section connected to the motor section, a feed passage member having fuel passage and a suction filter, wherein:

the pump section comprises an impeller driven by the motor section, and a pump cover and a pump casing each of which has a pump passage extending along the outer periphery of the impeller so that the impeller can pressurize fuel that is fed therein from the suction filter through the fuel passage;

each pump passage has an inlet port opening at a side of the pump section; and the fuel passage is divided into two feed passages each of which extends-to taper off toward the inlet port of one of the pump passages to be connected thereto at one end thereof.

2. A fuel pump, including a motor section, a pump section connected to the motor section, a feed passage member having a feed fuel passage and a suction filter, wherein:

the pump section comprises an impeller driven by the motor section and a pump housing having a pump passage extending along the outer periphery of the impeller so that the impeller can pressurize fuel that is fed therein from the suction filter through the feed passage;

the pump passage has an inlet port opening at a side of the pump housing;

the feed passage extends toward the inlet port to be connected thereto at one end thereof without an edge; and the feed passage becomes narrower toward the inlet port.

3. The fuel pump as claimed in claim 2, wherein the one end of the feed passage connected to the pump passage has approximately the same cross-sectional area as the inlet port of the pump passage.

4. A fuel pump comprising:

a motor section including a DC motor:

a pump section including an impeller driven by the motor section and a cylindrical pump housing having a pump passage extending along the outer periphery of the impeller so as to pressurize fuel that is fed therein, the pump passage having an inlet port opening at a peripheral portion of the pump housing;

a suction filter for filtering fuel sent thereto; and a feed passage member having a feed passage for connecting the pump passage and the suction filter, wherein the feed passage extends from the suction filter to taper off toward the inlet port to be connected thereto at its down stream end.

5. The fuel pump as claimed in claim 4, wherein the downstream end of the feed passage has approximately the same cross-sectional area as the inlet port of the pump passage.

6. The fuel pump as claimed in claim 4, wherein the suction filter has a filter cover, and the feed passage member is a portion of the filter cover.

7. A fuel pump to be disposed in a fuel tank to supply pressurized fuel to an internal combustion engine comprising:

a motor section including a DC motor:

a pump section including an impeller driven by the motor section and a cylindrical pump housing having a pump passage extending along the outer periphery of the impeller so as to pressurize fuel that is fed therein, the pump passage having an inlet port opening at a peripheral portion of the pump housing;

a suction filter having a filter cover, connected to the pump section, for filtering fuel sent to the pump section from the fuel tank; and a feed passage member disposed in the filter cover, the feed passage member having a smooth feed passage connecting the pump passage and the suction filter, wherein the feed passage tapers off toward the inlet port of the pump passage to be connected thereto.

8. A fuel pump to be disposed in a fuel tank to supply pressurized fuel to an internal combustion engine comprising:

a motor section including a DC motor;

a pump section including an impeller driven by the motor section and a cylindrical pump housing having a pair of pump passages respectively extending along the outer periphery of the impeller on opposite sides of the impeller so as to pressurize fuel that is fed therein, the pump passages having inlet ports opening at peripheral portions of the pump housing;

a suction filter having a filter cover, connected to the pump section, for filtering fuel sent to the pump section from the fuel tank; and a feed passage member disposed in the filter cover, the feed passage member having a pair of smooth feed passages respectively connecting the pump passages and the suction filter, wherein each feed passage tapers off toward the inlet port of the pump passage to be connected thereto.

* * * * *